US011767638B2

(12) United States Patent
Henninger et al.

(10) Patent No.: US 11,767,638 B2
(45) Date of Patent: Sep. 26, 2023

(54) METHOD AND DEVICE FOR STARCH APPLICATION

(71) Applicant: VOITH PATENT GMBH, Heidenheim (DE)

(72) Inventors: Christoph Henninger, Heidenheim (DE); Michael Doermann, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 299 days.

(21) Appl. No.: 17/263,634

(22) PCT Filed: Jul. 9, 2019

(86) PCT No.: PCT/EP2019/068310
§ 371 (c)(1),
(2) Date: Jan. 27, 2021

(87) PCT Pub. No.: WO2020/020626
PCT Pub. Date: Jan. 30, 2020

(65) Prior Publication Data

US 2021/0189657 A1 Jun. 24, 2021

(30) Foreign Application Priority Data

Jul. 27, 2018 (FI) ..... 20180087

(51) Int. Cl.
*D21H 19/54* (2006.01)
*B05C 1/08* (2006.01)
(Continued)

(52) U.S. Cl.
CPC ..... *D21H 19/54* (2013.01); *B05C 1/0834* (2013.01); *B05C 5/008* (2013.01); *D21G 9/009* (2013.01); *D21H 17/28* (2013.01)

(58) Field of Classification Search
CPC ..... D21H 23/56; D21H 19/54; D21H 23/58; D21H 17/28
(Continued)

(56) References Cited

U.S. PATENT DOCUMENTS 4,259,921 A 4/1981 Wallsten
5,383,371 A 1/1995 Laitinen
(Continued)

FOREIGN PATENT DOCUMENTS

CA 1142747 A 3/1983
DE 19716647 A1 10/1998
(Continued)

OTHER PUBLICATIONS

Herbert Holik (Editor): "Handbook of Paper and Board", Second, Revised and Enlarged Edition, vol. 1, 2013 Wiley-VCH Verlag GmbH & Co. KGaA, Germany.
(Continued)

*Primary Examiner* — Mark Halpern
(74) *Attorney, Agent, or Firm* — Laurence A. Greenberg; Werner H. Stemer; Ralph E. Locher

(57) ABSTRACT

A method and a device for the application of starch on a moving fiber web, especially on a packaging paper web such as a testliner or a corrugated medium web, include first applying starch to a first roll and/or a second roll and passing the fiber web through a treatment nip formed by the first roll and the second roll. At least one of the first or the second roll, preferably both rolls, have a hardness of 15 P&J (Pusey & Jones) or lower, preferably 5 P&J or lower and most preferably 1 P&J or lower. The starch is applied to the first roll and/or the second roll by a slot die and/or a slide die and then transferred to the fiber web in the treatment nip.

12 Claims, 4 Drawing Sheets

(51) Int. Cl.

| | |
|---|---|
| ***B05C 5/00*** | (2006.01) |
| ***D21G 9/00*** | (2006.01) |
| ***D21H 17/28*** | (2006.01) |

(58) Field of Classification Search
USPC ..... 162/175
See application file for complete search history.

(56) References Cited

U.S. PATENT DOCUMENTS

| | | | |
|---|---|---|---|
| 5,789,022 | A | 8/1998 | Kustermann et al. |
| 5,887,517 | A | 3/1999 | Liang et al. |
| 8,425,721 | B2 | 4/2013 | Tynkkynen et al. |
| 8,652,594 | B2 | 2/2014 | Koenig et al. |
| 8,835,384 | B2 | 9/2014 | Terzic et al. |
| 2003/0025230 | A1 | 2/2003 | Van Haag |
| 2003/0221808 | A1 | 12/2003 | Capizzi |
| 2005/0223913 | A1 | 10/2005 | Hirooka et al. |
| 2008/0087216 | A1 | 4/2008 | Damrau et al. |
| 2008/0128103 | A1 | 6/2008 | Kangas et al. |
| 2009/0317549 | A1 | 12/2009 | Tan et al. |
| 2016/0038969 | A1 | 2/2016 | Schmitt |

FOREIGN PATENT DOCUMENTS

| | | | |
|---|---|---|---|
| DE | 10012344 | A1 | 9/2001 |
| DE | 102006057870 | A1 | 6/2008 |
| DE | 102008040057 | A1 | 1/2010 |
| DE | 102011017672 | A1 | 11/2011 |
| DE | 102015204975 | A1 | 9/2016 |
| DE | 102016114968 | A1 | 2/2017 |
| EP | 2273009 | A1 | 1/2011 |
| EP | 2518212 | A1 | 10/2012 |
| EP | 2559809 | A1 | 2/2013 |
| FI | 86771 | B | 6/1992 |
| FI | 103354 | B | 6/1999 |
| FI | 20021348 | A | 1/2004 |
| FI | 121084 | B | 6/2010 |
| FI | 124591 | B | 10/2014 |
| FI | 126292 | B | 9/2016 |
| FI | 127948 | B | 5/2019 |
| JP | 2001300386 | A | 10/2001 |
| JP | 2002263540 | A | 9/2002 |
| WO | 2004001133 | A2 | 12/2003 |
| WO | 2012072873 | A1 | 6/2012 |

OTHER PUBLICATIONS

Antti Arjas: "Paperin Valmistus", Suomen papaeri-insinoorien yhdustyksen oppi-ja kasikirja III osa 2, [Paper Manufacturing: Textbook and Handbook of the Finnish Association of Paper Engineers Part III 2] 2nd edition, 1983.

Hans Mueller: "Article twogether", on behalf of the Voith Paper Technology team.

Konrad Herrmann (Editor): "Hardness Testing—Principles and Applications", 2010 ASM International, Ohio www.asminternational.org.

Donald R. Askeland: "The Science and Engineering of Materials", 1998 (SI edition) Stanley Thornes (Publishers) Ltd.

Schaefer Rolls: "Roll covers for the paper making industry" Size presses, film presses, Schaefer Rolls e3 Mar. 2010, www.schaeferrolls.com.

Martin Kustermann: "Vibration in Film presses", N:\TECHDIV\Tecnical Programs\Conference\00 COAT\Final Manuscripts\16-01 Kustermann 01-24-00.DOC, pp. 1-13, Apr. 13, 2000.

Risto Timperi: "Telahiomon Tuotannon Laepimenoajan Ja Laadun Optimointi", [Optimization of roll grinder production lead time and quality], Diploma Thesis, LUT School of Technology (2015)—English abstract.

SizeGem: "Hard thermal coating for pond sizing rolls", Valmet Corporation, SER33158 V4 EN Sep. 2014.

SizeGem C: "Composite roll cover for pond sizer", Valmet Corporation, SER33255 VJ EN Mar. 2017.

Risto Timperi: "Telahiomon tuotannon laepimenoajan ja laadum optimointi", [Optimization of roll grinder production lead time and quality], LUT School of Technology, Dec. 2, 2015, http://lutpub.lut.fi/handle/10024/117825—English translation.

Harri A. Heikkila: "OptiSizer Hardnip ProPapier PM1 GmbH Burg Hardnip-Sizer", Valmet Quotation VTQR00419.2 May 26, 2017.

Valmet: "Valmet's new hard nip sizing technology started-up at Propapier in Germany", Valmet Oyj's trade press release May 7, 2018.

"Hardness Correlation Table" D6, The Polyurethane Solution.

METHOD AND DEVICE FOR STARCH APPLICATION

This application is a 371 of PCT/EP2019/068310 filed 9 Jul. 2019.

BACKGROUND OF THE INVENTION

Field of the Invention

The invention relates to a method and a device for treating a fiber web. Especially, the invention relates to a method for the application of starch on a moving fiber web, especially on a packaging paper web such as a testliner or a corrugated medium web, in which first starch is applied to a first roll and/or a second roll and the fiber web is passed through a treatment nip formed by the first roll and the second roll. The invention also relates to a device for the application of starch on a moving fiber web including a first roll and a second roll positioned to form a treatment nip for the fiber web as well as an application device for the application of starch on at least one roll.

For the production of paper, board and packaging web the use of waste paper is increasing due to its economic and environmental benefits. Especially for grades like testliner (TL) or corrugated medium (CM) waste paper is usually the only fiber source that is used. But the quality of the waste paper that is used for these grades has been seen deteriorated over the last years since the number of recycling cycles is increasing. The accumulation of fillers and a reduction of fiber quality due to mechanical and chemical damaging of the fibers lead to a reduction in several strength properties of the produced board and packaging papers.

The addition of fillers like mineral pigments (e.g. $CaCo_3$, $TiO_2$, sand . . . ) reduces the wet web strength of the paper. This causes an increased number of sheet breaks during production.

The deteriorated fiber quality, e.g. the reduced fiber length, can be partially compensated by the treatment of the fiber web with synthetic binders like polymer-latex. Alternatively, the fiber web can be treated with natural binders like starch. Since the use of polymer-latex is usually expensive, the use of starch is often preferred.

The application of starch is a standard for a long time. Starch may be applied directly in the pulp stock or may be sprayed on a wet web in the forming section of a paper machine. But starch is also applied in a more efficient way after the press section and a pre-drying section. Here, the starch can also be sprayed on the fiber web, but is usually applied with a film press or a sizepress. As an example DE 10 2011 076718 describes the use of a size press in the production of testliner, in the case of recycled fibers with low quality.

Due to the mentioned decreasing quality of the fiber material, and also due to the increased production speed for most paper grades including TL and CM, there is a need in the industry for an efficient way to further increase the strength properties of the web.

In the application FI 20170013, the present applicant already discussed some related aspects.

SUMMARY OF THE INVENTION

The object of the present invention is to provide a technologically and economically efficient way to increase the strength of the fiber web.

A further object of the invention is to provide an efficient way to apply starch to a moving fiber web.

Another object of the invention is to provide a method for the stable production of testliner (TL) and corrugated medium (CM) even with a low quality of the raw material.

The above objects and those which will become apparent later have been fully reached by a method and a device according to the invention as described below.

Concerning the method, the object is reached by a method for the application of starch on a moving fiber web, especially on a packaging paper web like a testliner or a corrugated medium web, where first starch is applied to a first roll and/or a second roll and then the fiber web is passed through a treatment nip formed by the first roll and the second roll, characterized in that at least one of the first or the second roll, preferably both rolls have a hardness of 15 P&J (Pusey & Jones) or lower. Additionally, the starch is applied first to the first roll and/or the second roll via a slot die and/or a slide die and then transferred to the fiber web in the treatment nip. The hardness according to P&J is a common measure for rolls. It can be determined by commercially available devices like the Zwick 3108 P&J hardness tester, meeting the requirements of ASTM D531-89 standard.

If not stated otherwise, the term hardness of a roll is understood as the hardness of the outer layer or cover of the respective roll, even if the inner layers, i.e. those not contacting the fiber web, may have a different hardness.

The inventors surprisingly discovered that by using one or even two rolls with a relatively high hardness in a treatment nip, the starch can be transferred to the fiber web much more efficiently. Today, the rolls in standard sizepresses or film-presses have a hardness of 20 P&J or higher, that means, the rolls today are significantly softer than in the present invention. This harder roll has been found to improve the starch transfer to the fiber web.

The application of the starch according to the invention is realized by first applying the starch to the first roll and/or the second roll via a slot die and/or a slide die and then transferred to the fiber web in the treatment nip.

Slot dies and slide dies per se are well known in the field of paper coating.

From a slot die, starch can be applied in the form of a curtain, or in the form of a jet. When a slide die is used, the starch is first sliding a certain length on an inclined surface before falling on the moving web as a curtain.

Here, starch may be applied to one or both rolls which results in either a one-sided or a two-sided application of the starch to the fiber web.

The correct dosage of the starch to the roll is important for the performance of the method.

The standard film presses with soft rolls often use systems that apply a higher amount of starch to the roll than needed. The exact metering is achieved by removing the surplus starch from the roll with a rod or a blade.

Trials of the applicant showed, that these contacting rods or blades are not suitable to be used for the hard rolls according to the present invention. They are prone to increased wear and process stability is difficult to guarantee.

Therefore, a contactless starch application of the roll is desirable. But the spraying of starch to a roll with a set of spray nozzles involves many problems including the uniform distribution of the starch over the whole width of the fiber web. Also these nozzles have to be cleaned quite often. This leads to downtime of the coating machine which renders the method ineffective.

Therefore, the invention uses either a slot die or a slide die to apply the starch to the roll. These dies dose the needed amount of starch in a contactless way, therefore avoiding the disadvantages of rods or blades. On the other hands, they guarantee a uniform starch distribution and are not so prone to soiling compared to spraying nozzles.

Advantageous features of the inventive method are described in the dependent claims.

The curtain or the jet can have a width which is at least as wide as the fiber web, From a slot die, starch can be applied under the influence of gravity in the form of a free falling curtain.

Alternatively, a slot die can be used to apply the starch in the form of a jet, if for example the starch solution in the slot die is set under a certain pressure.

In a preferred embodiment, the starch is applied to the first roll and/or the second roll in the form of a free falling curtain. Since the curtain if falling under the influence of gravity, the curtain will contact the roll on its upper half, in many cases at or near the 12 o'clock position. While the 12 o'clock position may be advantageous, a different positioning of the dies is also possible. Depending on the geometry of the rolls and the web run, the impact point of the curtain may be positioned at or near the 10 o'clock or the 11 o'clock or the 1 o'clock or the 2 o'clock position or other suitable spots in between.

If the starch is applied from a slot die in the form of a jet, the jet nozzle can be positioned at any position around the roll. It is also possible that this jet contacts the roll on the lower half.

It may be advantageous to use even harder rolls. In some applications, at least one of the first or the second roll, preferably both rolls have a hardness of 5 P&J or lower, preferably 1 P&J or lower. Even a hardness of 0 P&J can be beneficial. This can for example be achieved by hard ceramic or metal surfaces of the roll.

In an advantageous variant, the treatment nip may be formed by two hard rolls, having a hardness of 15 P&J and less. This combination can further improve the starch transfer to the fiber web.

In another advantageous variant, the treatment nip may be formed by a hard roll, having a hardness of 15 P&J and less with a softer roll. The softer roll may have a hardness of more than 15 P&J, especially more than 20 P&J The fiber web according to the present invention may be a single layer or a multi-layer web. The layers of the multi-layer web can be produced in two, three or more forming sections and joined together, usually before the inventive starch application. Such multi-layer webs are common for TL and CM applications.

As described earlier, the fiber web can be produced using fibers generated from waste-paper. Here, the strength generating effect of the invention is especially beneficial.

In order to further improve the starch transfer, the lineload of the treatment nip may be chosen between 30 kN/m and 140 kN/m, preferably between 60 kN/m and 120 kN/m or even between 80 kN/m and 100 kN/m.

The production speed for TL and CM on modern machines is very high, at least more than 800 m/min. The standard is more than 1000 m/min, going up to 1500 m/min or even 1900 m/min. At such high speeds, the efficient starch transfer is especially important, since they are usually operating at the upper strength limit of the web, and an increase in speed is probably limited by a lack of strength in the fiber web.

In some applications, it may be beneficial to adapt the properties of the starch used. There, a solid content of the starch between 6% and 25%, preferably between 8% and 18% can be chosen.

A viscosity between 5 mPas and 60 mPas, preferably between 10 mPas and 40 mPas of the starch may be chosen.

The combination of the above mentioned solid contents and the viscosity has been found to be especially beneficial.

If not otherwise stated, viscosity values in this application are always understood as Brookfield viscosities measured at 50° C. with 100 rpm.

The starch may be applied at a temperature between 50° C. and 80° C.

Usually, after the starch application and some further drying, the fiber web is reeled at a reeler. In some preferred applications, e.g. for TL and CM, the basis weight of the fiber web at the reeler can be between 60 g/m$^2$ and 250 g/m$^2$, more often between 90 g/m$^2$ and 170 g/m$^2$.

In a preferred realization of the method, the application of starch in the inventive step is adjusted such that the starch content of the fiber web at the reeler lies between 2.5% and 6% of the basis weight. This amount of starch is usually sufficient to achieve the desired increase in strength properties.

In another preferred realization of the method, the crowning of the rolls may be adapted to obtain a length to the treatment nip that is homogeneous over the cross directional width of the rolls.

Concerning the device, the object is reached by a device for the application of starch on a moving fiber web comprising a first roll and a second roll positioned to form a treatment nip for the fiber web as well as application means for application of starch on at least one roll characterized in that at least one of the first or the second roll, preferably both rolls have a hardness of 15 P&J (Pusey & Jones) or lower. In addition, the device further comprises a slot die and/or a slide die for the application of starch to the roll.

Again, advantageous features are described in the dependent claims.

It may be advantageous to use even harder rolls. In some applications, at least one of the first or the second roll, preferably both rolls have a hardness of 5 P&J or lower preferably 1 P&J or lower.

In an advantageous embodiment, the treatment nip may be formed by a hard roll, having a hardness of 15 P&J and less with a softer roll. The softer roll may have a hardness of more than 15 P&J, especially more than 20 P&J. This combination can further improve the starch transfer to the fiber web.

It can be advantageous, if the device further comprises means to remove the air boundary layer from at least one of the first roll or the second roll.

These means to remove the air boundary layer may comprise at least one of a doctor blade, an air jet, a foil or a brush.

In most applications these means will be positioned before the impact point of the curtain on the roll—seen in the direction of rotation of the roll.

In preferred embodiments of the application device, the diameters of the first roll and the second roll are the same or differ by less than 10%.

Depending on the fiber web and also on the production speeds, using such a relatively hard nip for size application may generate unwanted vibrations. If the two rolls have the same size, or approximately the same size, this tendency to create vibrations can be reduced, therefore increasing the stable runability of the machine.

Usually it will be advantageous if the diameters of the first roll and/or the second roll are between 0.25 m and 2 m, especially between 0.7 m and 1.8 m.

In another preferred embodiment of the device the first roll has a cover comprising a metal or a ceramic with a layer thickness up to 800 μm or even 1000 μm, preferably between 50 μm and 150 μm, and/or the second roll has a cover comprising one of a rubber, a polyurethane or a composite material with a layer thickness between 10 mm and 20 mm.

Depending on the application, it is also possible that the first and the second roll have a cover comprise a metal or a ceramic as described above, or that the first and the second roll have a cover comprising one of a rubber, a polyurethane or a composite material.

When choosing the layers, several aspects should be considered. At first, the desired hardness of the invention has to be reached. Additionally, a higher thickness of a layer can increase the possible running time of the roll. On the other hand are rolls with e.g. a thicker top layer more likely to generate unwanted vibrations. The values given above represent an optimal compromise for many applications.

It should be noted, that the rolls in the device may be in principal of any type used in the field. In some embodiments it may for example be beneficial if at least one of the rolls is a shoe-roll or a controlled deflection roll.

The positioning of the rolls may be chosen freely. The first and the second roll may be placed side by side with the fiber web moving vertically through the nip.

Alternatively they may be placed on top of each other with the web passing horizontally. But any oblique positioning is also possible. If the first and the second roll have different hardness, while they may be in general be positioned in any way, it may be preferable to choose the higher position for the soft roll.

In another preferred embodiment, at least one of the first or the second roll comprises sensor means to measure the nip load. In an even more preferred embodiment, these sensor means are means to measure a cross directional profile of the nip load. Such means can comprise among others fiber optical sensors, one or more sensors based on Piezo elements, or film sensors.

If the first and the second roll have a different hardness, it may be beneficial to position sensor means at or in the softer roll. In an even more preferred embodiment, these sensor means are also capable of determining the length of the treatment nip (e.g. the machine directional length), especially over the whole cross-directional width of the treatment nip.

Based on the measurements of such sensor means, it is possible to adjust for example the crowning of a roll and/or the nip load to adjust the conditions in the treatment nip and optimize the starch transfer to the web depending on the characteristics of the produced product, like for example the thickness of the web, the base weight or the quality of the used fiber material.

In the following, the invention is described in more details with reference to the accompanying drawings.

Here, the starch is applied by two slot dies 3 to the surface of the rolls 1, 2 in the form of a jet and from here transferred to the web 5 in the nip. In order to achieve an improved transfer of the starch to the web, one roll 1, 2 or even both rolls 1, 2, have a hardness of 15 P&J (Pusey & Jones) or lower. Especially at least one roll may have a hardness of less than 5 P&J or even less than 1 P&J.

Figure 1:
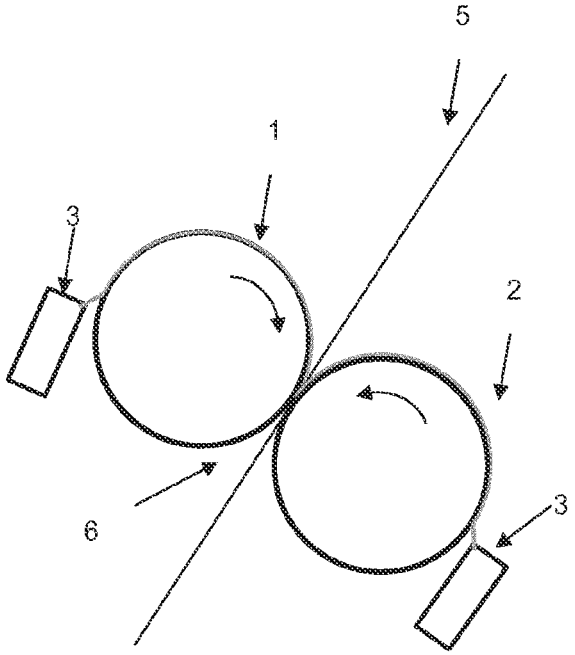
FIG. 1 shows a schematic view of a device according to one aspect of the invention.

The diameter of the rolls 1, 2 is in the example of FIG. 1 chosen to be equal, in the range between 0.7 m to 1.8 m, but can be larger or smaller, depending on the application.

The starch used between can have a solid content between 6% and 25%, preferably between 8% and 18%.

In addition, a viscosity between 5 mPas and 60 mPas, preferably between 10 mPas and 40 mPas of the starch may be chosen.

The nipload of the nip 6 can be set in the range between 30 kN/m and 140 kN/m, preferably between 60 kN/m and 100 kN/m. One roll 1, 2 can for example be chosen to comprise a layer of ceramic or metal, while the other roll may comprise layer of rubber, polyurethane or a composite material.

The typical starch amount that is transferred with a device according to the invention is usually between 2.5% and 6% of the basis weight.

DETAILED DESCRIPTION OF THE INVENTION

Figure 2:
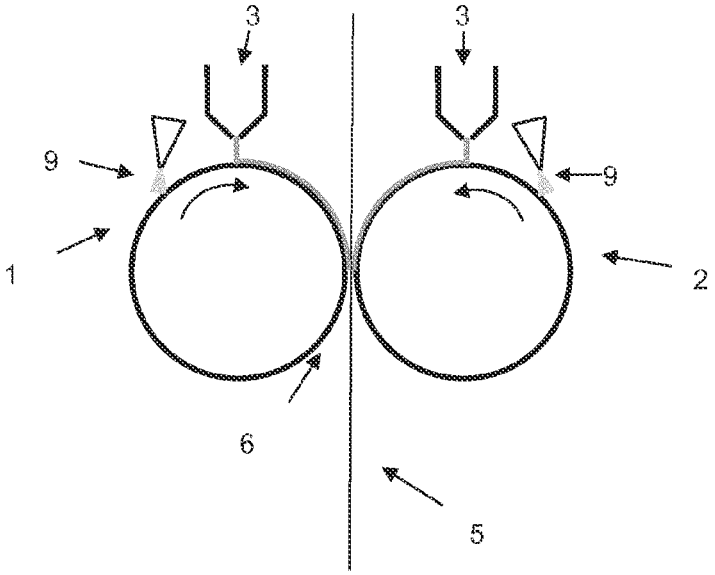
FIGS. 2 and 2*a* shows a schematic view a device according to another aspect of the invention.

FIG. 2 shows an embodiment of another aspect of the invention.

While the device according to FIG. 2 may comprise similar rolls 1, 2 as the device in FIG. 1, they are positioned side by side and the fiber web 5 is moving vertically through the nip. In this embodiment, the starch is applied to each of the rolls 1, 2, by a slot die 3. In contrast to FIG. 1, the starch is applied in the form of a free falling curtain. Therefore, the slot dies 3 are positioned on the upper half of the roll 1, 2, preferably at or near the 12 o'clock position. The device of FIG. 2 also comprises means 9 to remove the air boundary layer from the first roll 1 and the second roll 2. Such means are beneficial to avoid the disturbance of the curtain by the air in the boundary layer and therefore to establish a stable curtain and a uniform starch application. While the device 9 in FIG. 2 is in the form of an air nozzle 9 generating an air jet, there are a variety of possible alternatives like doctor blades, brushes or foils.

All the features concerning roll size, hardness or composition, nip load and starch properties mentioned for the embodiment of FIG. 1 are also valid for the embodiment of FIG. 2.

Figure 2A:
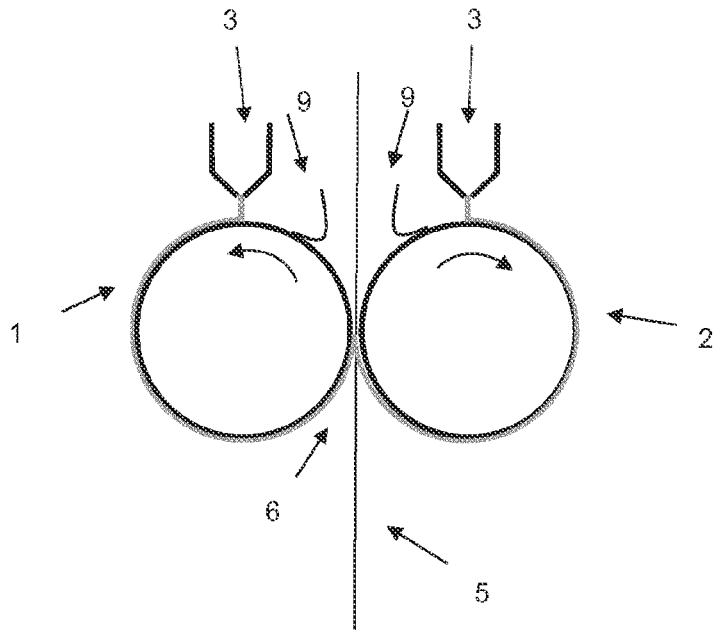

FIG. 2*a* shows a very similar device as FIG. 2. The main difference is the direction of rotation of the roll. While in FIG. 2 the impact point of the curtains is relatively close to the treatment nip 6, FIG. 2*a* shows that this does not have to be the case. It is very well possible to apply the starch to a roll 1, 2 and then transport it for a longer distance on the surface of the roll. FIG. 2*a* shows an embodiment, where the starch is applied near the 12 o'clock position on the first roll 1, and is then transported on the roll surface in counter clockwise rotation to the treatment nip 6, which is approximately in 3 o'clock position. To demonstrate a possible alternative, the device 9 to remove the air boundary layer is here shown as a foil or a flexible blade.

Figure 3:
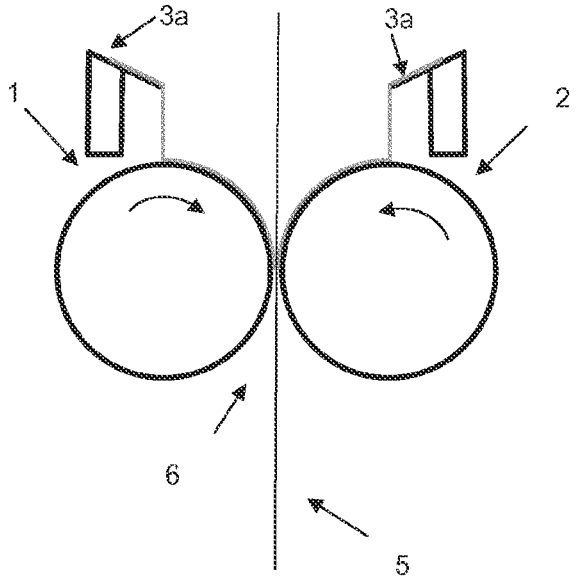
FIG. 3 shows a schematic view a device according to another aspect of the invention.

The embodiment of FIG. 3 is very similar to the embodiment of FIG. 2. It only differs in the way the starch is applied to the rolls 1, 2 by slide dies 3*a*. The starch is again applied in the form of a curtain. Even though the embodiment in FIG. 3 does not explicitly show means 9 to remove the air boundary layer from the rolls such means 9 can be beneficial in this embodiment as well to stabilize the curtain.

Devices like the embodiments shown in the figures are capable of being used to perform methods according to the present invention.

Figure 4A:
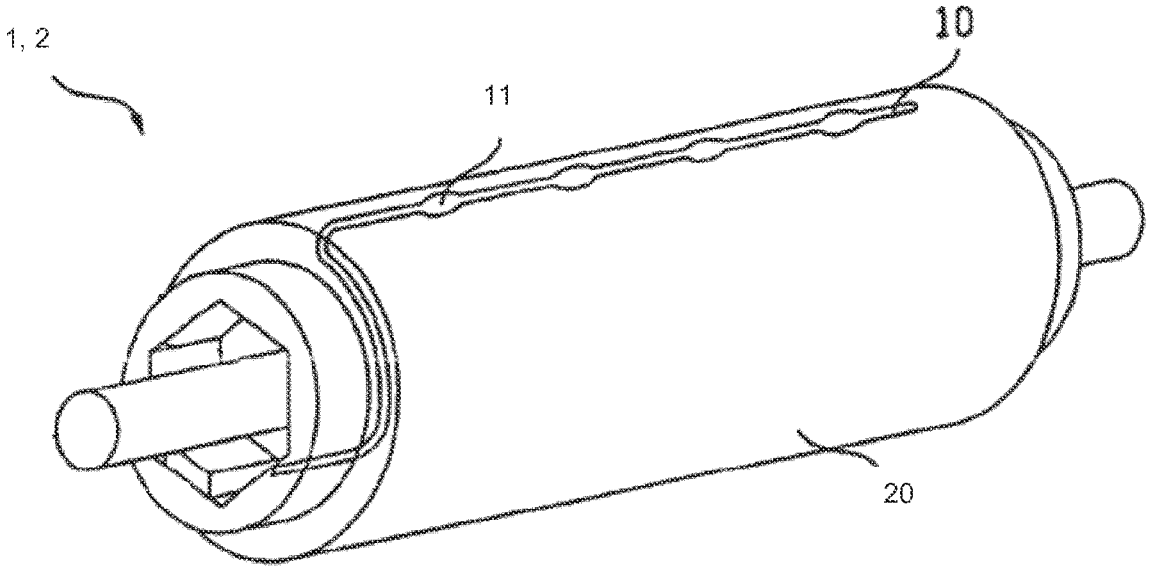
FIGS. 4*a* and 4*b* show different embodiments of a roll with sensing means according to another aspect of the invention In FIG. 1 the device according to one aspect of the invention comprises a first roll 1 and a second roll 2, forming a treatment nip 6. The fiber web 5, which may for example be a testliner (TL) or corrugated medium (CM) web 5, passes through the nip 6. Since the rolls are placed in an oblique position, the web 5 is also moving in an oblique direction, preferably at an angle of about 45° w.r.t. the horizontal line.
Figure 4B:
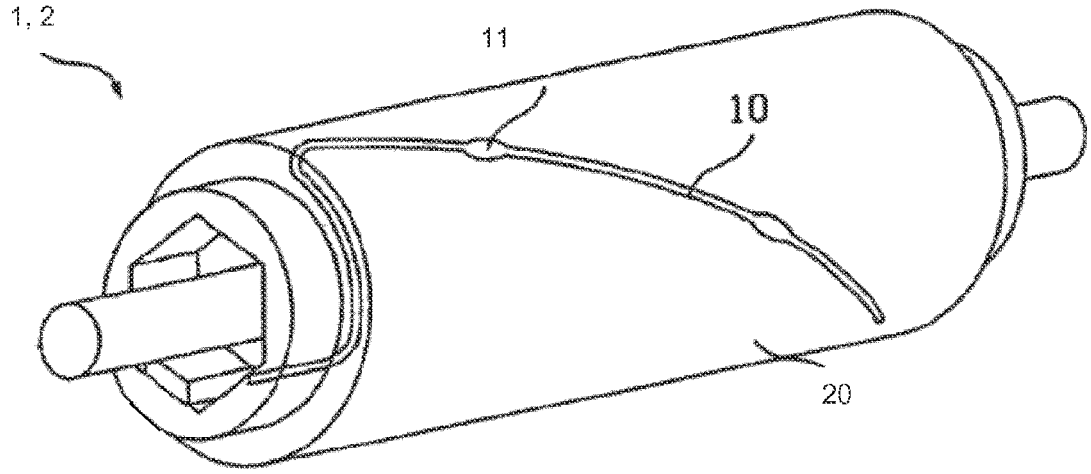

FIGS. 4*a* and 4*b* show a first or a second roll 1, 2, comprising a set of sensor means 11 to measure the nip load. The sensor means 11 can be integrated into the roll cover 20. The sensor means 11 in these examples are connected by a signal carrier 10.

This signal carrier may carry electrical or optical signals, depending on the nature of the sensing means.

In FIG. 4*a*, the sensing means are all positioned along a line in crossmachine direction. In the embodiment in FIG. 4*b*, the sensor means are positioned helically around the circumference of the roll 1, 2.

The sensor means 11 may for example be included in the top layer 20 or cover of the roll 1, 2, or be positioned between the top layer and the next following layer.

The invention claimed is:

1. A device for the application of starch on a moving fiber web, the device comprising:

a first roll and a second roll positioned to form a treatment nip for the fiber web, said first roll and said second roll each having an outer layer or cover with a hardness of 1 P&J (Pusey & Jones) or lower; and an applicator for applying starch on at least one of said rolls, said applicator including at least one of a slot die or a slide die forming a free-falling curtain of starch with at least one of a solid content between 6% and 25% or a viscosity between 5 mPas and 60 mPas.

2. The device according to claim 1, wherein:

said free-falling curtain of starch has at least one of a solid content between 8% and 18%.

3. The device according to claim 1, wherein:

said free-falling curtain of starch has a viscosity between 10 mPas and 40 mPas.

4. The device according to claim 1, which further comprises a device for removing an air boundary layer from at least one of said first roll or said second roll.

5. The device according to claim 4, wherein said device for removing the air boundary layer includes at least one of a doctor blade, an air jet, a brush or a foil.

6. The device according to claim 4, wherein said first roll and said second roll have diameters being identical or differing by less than 10%.

7. The device according to claim 4, wherein at least one of said first roll or said second roll has a diameter of between 0.25 m and 2 m.

8. The device according to claim 4, wherein at least one of said first roll or said second roll has a diameter of between 0.7 m and 1.8 m.

9. The device according to claim 4, wherein at least one of said rolls has:

said cover and said cover is formed of a metal or a ceramic with a layer thickness of less than 1 mm, or said cover and said cover is formed of a rubber, a polyurethane or a composite material with a layer thickness of between 10 mm and 20 mm.

10. The device according to claim 9, wherein said cover formed of a metal or a ceramic has a layer thickness of between 50 μm and 150 μm.

11. The device according to claim 4, wherein at least one of said first roll or said second roll has at least one sensor for measuring a nip load.

12. The device according to claim 1, wherein at least one roll selected from the group consisting of said first roll and said second roll is a controlled deflection roll.

* * * * *